US008122902B2

(12) United States Patent
Malka

(10) Patent No.: US 8,122,902 B2
(45) Date of Patent: Feb. 28, 2012

(54) APPARATUS AND METHOD FOR UNCLOGGING A PIPE

(76) Inventor: Rafael Malka, Ashdod (IL)

( * ) Notice: Subject to any disclaimer, the term of this patent is extended or adjusted under 35 U.S.C. 154(b) by 273 days.

(21) Appl. No.: 12/419,313

(22) Filed: Apr. 7, 2009

(65) Prior Publication Data

US 2009/0188568 A1 Jul. 30, 2009

(30) Foreign Application Priority Data

Apr. 7, 2008 (IL) ..... 190648

(51) Int. Cl.
*B08B 3/04* (2006.01)

(52) U.S. Cl. ..... 137/15.05; 137/240; 4/255.06

(58) Field of Classification Search ..... 137/240, 137/238, 15.04, 15.05; 4/255.06, 255.04, 4/255.01

See application file for complete search history.

(56) References Cited

U.S. PATENT DOCUMENTS

| | | | | |
|---|---|---|---|---|
| 1,745,923 | A * | 2/1930 | Frizzell | 4/255.03 |
| 3,937,404 | A * | 2/1976 | Johnson | 4/255.09 |
| 4,083,661 | A | 4/1978 | McPherson | |
| 4,141,090 | A * | 2/1979 | Rowan | 4/255.04 |
| 4,736,968 | A * | 4/1988 | Glegg | 285/179.1 |
| 4,998,412 | A * | 3/1991 | Bell | 62/126 |
| 5,921,207 | A * | 7/1999 | DiSalvo et al. | 122/388 |
| 5,964,238 | A * | 10/1999 | Junkin | 137/15.05 |
| 5,967,175 | A | 10/1999 | Bouzaglou | |
| 6,345,410 | B1 * | 2/2002 | Baker | 15/406 |
| 6,907,622 | B2 * | 6/2005 | Rasaei et al. | 4/255.04 |

FOREIGN PATENT DOCUMENTS

| | | |
|---|---|---|
| DE | 3300489 | 7/1984 |
| DE | 3822555 | 8/1989 |

* cited by examiner

*Primary Examiner* — Kevin Lee

(57) ABSTRACT

An apparatus and method for unclogging an obstructed conduit such as a wastewater pipe. The apparatus comprises at least one tube disposed in the drain pipe; and a fluid supply pipe for providing fluid from a fluid source, the supply pipe connected to the at least one tube that delivers the fluid to unclog the obstruction.

13 Claims, 6 Drawing Sheets

APPARATUS AND METHOD FOR UNCLOGGING A PIPE

FIELD OF THE INVENTION

The present invention relates to a method and apparatus for unclogging an obstructed conduit such as a wastewater pipe.

BACKGROUND OF THE INVENTION

Clogs in pipes are a nuisance, especially underground. Releasing the clogs typically requires time, manpower, tools and/or machinery, and may cause annoyances such as blocking roads and delays until manpower is available.

Some methods and mechanisms for dealing with obstructions in piping systems for sewage drainage or rain water runoff and the like have been devised. DE 3300489 discloses an apparatus comprising a screen for retaining and removing substances that may clog an outlet opening; and DE 3822555 relates to a throttle device for an outflow opening of a rain-water-retention chamber in a drainage system.

U.S. Pat. No. 5,967,175 describes a waste-line stoppage detector and automatic water shutoff system that is utilized to prevent the overflow of raw sewage from a plumbing fixture. Electronic shutoff valves are electronically connected to a waste line stoppage detector. The electronic waste line stoppage detector may be electronic, use a diaphragm or float ball with a switch.

U.S. Pat. No. 4,083,661 discloses a pneumatic sewage ejector that includes a tank for holding fluid sewage. When the sewage reaches a predetermined high level in the tank, it is ejected by pressurized air forced into the tank through a valve located inside the tank. The ejection of the fluid is initiated by a float which responds to the high fluid level in the tank by ascending and thereby moving the valve to an air-input position to admit pressurized air into the tank to expel the sewage. The valve remains in the air-input position until the fluid reaches a low level, at which time the float descends and moves the valve to a vent position to vent the pressurized air to the atmosphere. The float moves the valve between the air-input position and the vent position in one discrete step so that the valve cannot stop in an intermediate position.

The above-mentioned references are incorporated herein by reference in their entirety.

SUMMARY OF THE INVENTION

According to one aspect of the invention there is provided a method of unclogging an obstruction in a conduit or pipe, comprising thrusting, ejecting or forcing a fluid into the pipe in order to remove the obstruction.

According to another aspect of the invention there is provided an apparatus adapted to unclog an obstruction in a conduit or pipe, comprising at least one tube for thrusting or ejecting a fluid into the conduit, and a supply pipe for providing the fluid to the at least one tube.

According to one aspect of the invention there is provided a junction comprising an apparatus adapted to unclog an obstruction in a conduit or pipe, comprising at least one tube for thrusting or ejecting a fluid into the conduit or pipe, and a supply pipe for providing the fluid to the at least one tube.

According to one aspect of the invention there is provided a kit comprising components for unclogging an obstruction in a conduit or pipe. In some embodiments the components comprise one or more tube sections for disposing in the conduit or pipe, connectors for connecting the tube sections, a fluid supply pipe, and a valve with a regulating mechanism for controlling the fluid supply. Optionally the kit comprises one or more chemicals to add to the fluid. Optionally, the kit comprises a tank for the fluid.

The obstruction typically resides in an effluent pipe, which may be, without limiting, sewage, wastewater, rain water, or other effluent fluid such as industrial or environmental fluids.

For brevity and clarity, in the specification and claims, unless otherwise specified, the following terms, or inflections thereof, denote or relate to the following respective designations:

effluent—any flowing material that may contain an obstruction;

drain pipe—any pipe or conduit that may contain an obstruction;

flush—thrusting, ejecting or forcing a fluid into a drain pipe; and water or flushing water—any fluid usable for unclogging an obstruction.

In some embodiments of the invention, the flushing water comprises one or more supplementary ingredients, such as a surfactant or alkaline compound, which may assist in disintegrating or decomposing the obstruction.

In some embodiments of the invention, one or more tubes are disposed in a drain pipe and water is flushed under pressure in or into the drain pipe from the one or more tubes, wherein the flush pressure is greater than the pressure of the effluent flow.

In some embodiments, the water, optionally with supplementary ingredients, is provided from a municipal or regional water supply.

In some embodiments, the flushing pressure is obtained from a municipal or regional water supply. Optionally or alternatively, the pressure is obtained, or augmented, by a pump or a compressor or by other methods such as a container with pressurized gas such as air, or by a hydrostatic column.

In some embodiments, the water is flushed toward the clog and/or in the clog substance. Optionally, the water is ejected after the clog, effecting a flow that pulls and releases at least a part of the clog.

In some embodiments of the invention, water is flushed into an outlet drain pipe. Optionally or alternatively, the water is flushed into an inlet drain pipe. In some cases, the inlet flow is slow relative to the flushing water so that the flushing flow may unclog an obstruction even when that flushing water is directed in the opposite direction of the inlet flow. In some cases, the inlet flow is intermittent so that the flushing flow may unclog an obstruction when little of no effluent is flowing in the inlet pipe.

In some embodiments of the invention, flushing water into the drain pipe is effected manually. According to other embodiments, flushing water into the drain pipe is automatic.

According to an aspect of some embodiments of the present invention there is provided an apparatus for unclogging an obstruction in a drain pipe, comprising:

at least one tube disposed in the drain pipe; and a fluid supply pipe for providing fluid from a fluid source, the supply pipe connected to the at least one tube that delivers the fluid to unclog the obstruction.

In some embodiments the apparatus is configured to flush the fluid from the at least one tube into the drain pipe.

In some embodiments the apparatus is further comprises a mechanism that regulates the fluid delivery automatically.

In some embodiments the mechanism regulates the pressure of the fluid.

In some embodiments the mechanism regulates the fluid flow rate.

In some embodiments the mechanism comprises a valve.

In some embodiments the mechanism comprises an element for automatically controlling the valve according to an effluent level in a chamber into which the drain pipe connects.

In some embodiments the mechanism comprises an element for automatically controlling the valve according to an effluent level in the drain pipe.

In some embodiments the mechanism comprises an element for automatically controlling the valve according to an effluent flow rate in a chamber into which the drain pipe connects.

In some embodiments the mechanism comprises an element for automatically controlling the valve according to an effluent flow rate in the drain pipe.

In some embodiments the element comprises a float linked to the valve.

In some embodiments the element comprises at least one of a fluid level sensor, a flow rate meter and a flow velocity meter.

In some embodiments the apparatus further comprises a pump for pressurizing the fluid.

In some embodiments the apparatus further comprises a tank connected to the supply pipe for providing supplementary ingredients to the fluid.

In some embodiments the fluid is water.

In some embodiments the supply pipe connects to a water source.

In some embodiments the water source is a regional water supply.

According to an aspect of some embodiments of the present invention there is provided a method for unclogging an obstruction in a drain pipe, comprising:

disposing at least one tube into the drain pipe;

providing a fluid to the at least one tube; and flushing the fluid in the drain pipe for at least partially unclogging the obstruction.

In some embodiments the fluid is water.

In some embodiments the method further comprises supplementing the fluid with ingredients for assisting in unclogging the obstruction.

In some embodiments the method further comprises pressurizing the fluid to a pressure above the pressure in the drain pipe.

In some embodiments pressurizing comprises obtaining pressure from a regional water supply.

In some embodiments the method further comprises automatically regulating the flushing according to a determined clogging in the drain pipe.

In some embodiments the method further comprises automatically regulating the flushing according to an effluent level in a chamber into which the drain pipe connects.

In some embodiments the method further comprises automatically regulating the flushing according to an effluent level in the drain pipe.

In some embodiments the method further comprises automatically regulating the flushing according to an effluent flow rate in a chamber into which the drain pipe connects.

In some embodiments the method further comprises automatically regulating the flushing according to an effluent flow rate in the drain pipe.

According to an aspect of some embodiments of the present invention there is provided a junction having a plurality of pipe stubs, comprising:

at least one tube disposed in at least one pipe stub; and a fluid supply pipe for providing fluid from a fluid source, the supply pipe connected to the at least one tube, whereby the fluid is deliverable to unclog an obstruction in a pipe connected to the at least one pipe stub.

In some embodiments the junction further comprises a valve in the supply pipe.

In some embodiments the junction further comprises a mechanism for automatically regulating the valve according to effluent level in the junction.

In some embodiments the junction further comprises a mechanism for automatically regulating the valve according to effluent flow rate in the junction.

In some embodiments the junction further comprises a mechanism for automatically regulating the valve according to effluent level in a pipe stub.

In some embodiments the junction further comprises a mechanism for automatically regulating the valve according to effluent flow rate in a pipe stub.

In some embodiments the mechanism comprises a float linked to the valve.

In some embodiments the mechanism comprises a sensor for detecting at least one of fluid level, fluid flow and fluid velocity.

According to an aspect of some embodiments of the present invention there is provided a kit for unclogging an obstruction in a drain pipe, comprising:

a plurality of tube sections for disposing in the drain pipe;

connectors for connecting the tube sections;

a fluid supply pipe; and a valve with a regulating mechanism for controlling the fluid supply.

In some embodiments the mechanism comprises a float pivotally linked to the valve.

In some embodiments the kit further comprises at least one chemical to aid in unclogging the obstruction.

In some embodiments the kit further comprises at least one tank for holding flushing fluid.

BRIEF DESCRIPTION OF THE DRAWINGS

The invention may be understood upon reading of the following detailed description of non-limiting exemplary embodiments thereof, with reference to the following drawings.

Identical and/or equivalent and/or similar structures, elements, or parts that appear in more than one drawing are generally labeled with the same reference numeral. Dimensions of components and features shown in the figures are chosen for convenience or clarity of presentation and are not necessarily shown to scale or true perspective. For clarity, some structures are shown only partially or without perspective.

DESCRIPTION OF EMBODIMENTS OF THE INVENTION

The invention will be described with respect to the unclogging of a drain pipe such as is commonly found underneath street manhole covers and used to drain water from homes, apartment buildings, or other locations such as streets. Typically such drain pipes connect to a junction distribution box (hereinafter in the specification and claims: "junction"). However, it should be understood that the invention can be adapted by a person of ordinary skill in the art for use with a wide variety of conduits, pipes, tubes or junctions, and in a variety of settings.

Figure 1A:
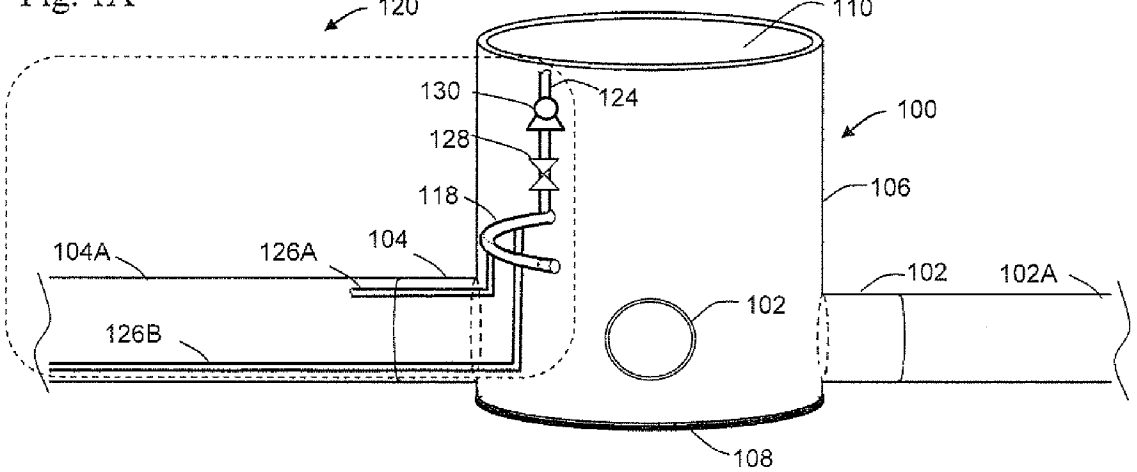
FIGS. 1A-1C schematically show some embodiments of an apparatus of the present invention.
Figure 1B:
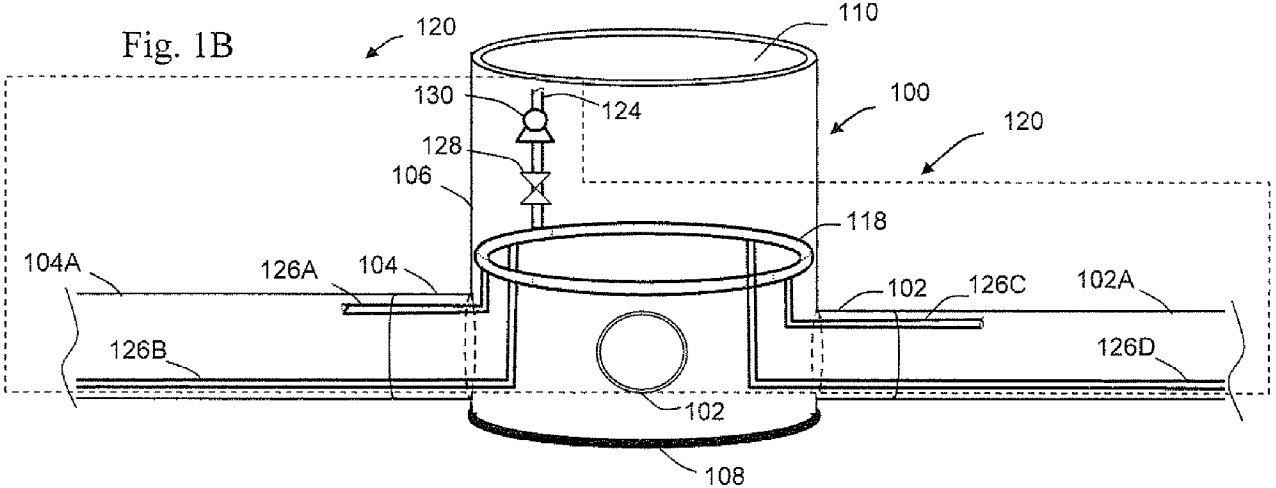
Figure 1C:
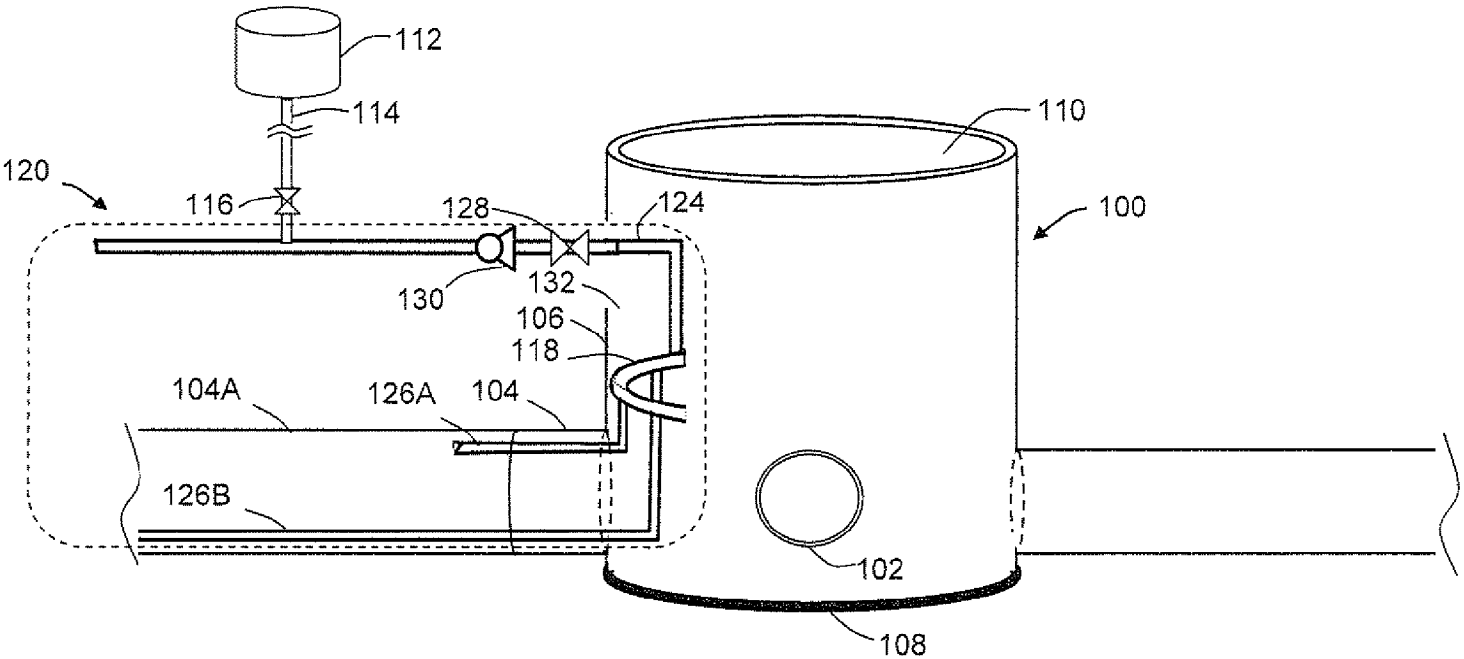

FIGS. 1A, 1B and 1C illustrate a typical, non-limiting example of a junction 100 comprising three inlet pipe stubs 102 (two visible), an outlet pipe stub 104, and a cylindrical wall 106 with a base 108 defining a cavity or chamber 110. Extending from pipe stubs 102 and 104 are pipes 102A and 104A, respectively. Effluent flow reaches chamber 110 via inlet pipes 102A and continues to drain into outlet pipe 104A.

Chamber 110 allows access to pipe stubs 102 and 104 and pipes 102A and 104A, and is used in the specification as a non-limiting framework for examples of embodiments of the invention. The number and relative diameters of inlet pipes 102A or outlet pipes 104A shown are merely exemplary and any practical number of inlet pipes 102A or outlet pipes 104A and diameters thereof may be used in accordance with embodiments of the invention.

FIGS. 1A-1C further show an embodiment of an apparatus 120 for unclogging an obstruction in a drain pipe. Apparatus 120 comprises a fluid supply pipe 124 and one or more flushing tubes, represented by four flushing tubes 126A-126D which are shown disposed in one of the inlet pipes 102A and outlet pipe 104A. In some embodiments, flushing tubes 126 are inserted in all or some of inlet or outlet pipes 102A and 104A, respectively. Supply pipe 124 is fitted with a valve 128 for controlling the flow of flushing water, in terms of flow rate (volume per time) and/or velocity and/or pressure.

In some embodiments of the invention, in order to install apparatus 120, chamber 110 is exposed, such as by opening a manhole cover under which such junction 100 is typically located, as illustrated in FIGS. 1A and 1B. In other embodiments of the invention, as illustrated in FIG. 1C, wall 106 of junction 100 is opened, such as by drilling, and supply pipe 124 is installed in chamber 110 through an opening 132 in wall 106. Additionally, pipe 124 and other pipes (or tubes) 126 are installed via top or side of junction 100.

However, pipe 124 can be disposed in any appropriate location and manner. For retrofitting, supply pipe 124 may be installed through opening 132 made in wall 106; whereas in other embodiments the apparatus includes junction 100 or the junction is pre-formed with a suitable opening to accommodate supply pipe 124.

Valve 128 can be operated manually, or by other means such as an electro-mechanical mechanism (e.g., a locally or remotely controlled actuator, such as by a solenoid, not shown). In this regard, a system of apparatuses can be operated remotely to flush a series of drain pipes. Valve 128 may be located in the vicinity of junction 100 (e.g. within or adjacent the junction) or outside the vicinity of junction 100. Optionally, the function of valve 128 is carried out by a plurality of valves.

When valve 128 is opened, the water provided by supply pipe 124 is flushed into inlet or outlet pipes 102A or 104A thereby clearing or at least partially clearing the obstruction.

In order to provide water for flushing, flushing tubes 126A-D are connected to a water source (not shown), such as a regional water supply system or a reservoir, through supply pipe (or pipes) 124. The water is optionally supplemented with additional ingredients to assist in unclogging, such as surfactants and/or alkali or acidic chemicals. The pressure for flushing the water into pipes (or tubes) 126 is provided by the water supply system or a reservoir, for example, a reservoir in a sufficiently high location relative to junction 100. Optionally or alternatively, the pressure is provided, or augmented, by a pump 130. Pump 130 is manually operated, or operated by other methods such an electro-mechanical mechanism (e.g., a locally or remotely controlled actuator).

The water from supply pipe 124 is fed to flushing tubes 126 via a pipe 118. Pipe 118 is, optionally, constructed as a manifold that distributes water from supply pipe 124 to flushing tubes 126.

Flushing tubes 126 are disposed in inlet or outlet pipes 102A and 104A, respectively, and constructed such that they do not hinder effluent flow in pipes 102A or 104A, or at least not significantly. Typically, the outer diameters of water flushing tubes 126A-D are small relative to the inner diameters of inlet pipes 102A and outlet pipes 104A; however any appropriate diameter for the flushing pipes can be used. Likewise, according to the present embodiment, flushing tubes 126A-D can be of varying lengths.

In some embodiments of the invention, water flushing tubes 126 have an outer diameter of 5% to 10% of the inner diameter of pipes 102A and/or 104A. Optionally, water flushing tubes 126 have a diameter of 10% to 20%, or larger or smaller of pipes 102A and/or 104A. In some embodiments of the invention, water flushing tubes 126 are disposed in a drainage pipe for some length down an outlet pipe and/or up an inlet pipe. Optionally, the length of flushing tube 126 is in the order of 2 cm to 50 cm; optionally, the length is in the order of 50 cm to 1 m; optionally, the length is in the order of 1 m to several meters such as 2 m, 2.5 m, 3 m or more, or any intermediate length of the recited length ranges. In some embodiments of the invention, a plurality of flushing tubes 126 are disposed in a drainage pipe 102A or 104A, optionally each flushing tube 126 has a different length and/or diameter.

Figure 1D:
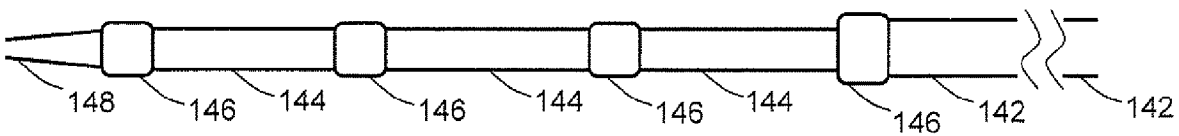
FIG. 1D schematically shows a flushing pipe according to another embodiment of the invention.

As illustrated in FIG. 1D, in some embodiments of the invention, flushing tubes 126 comprise a plurality of sections 144 that are fastened to each other, for example, by threaded connections 146 or the like, for ease of assembly and.or installation and/or manufacturing. In some embodiments, flushing tubes 126 are constructed by sections of different diameters, for example, tube 126 is narrower at the end from which flushing water exits than at the end adjacent junction 100. FIG. 1D schematically shows flushing tube 126 comprising a relatively large diameter section (or sections) 142 and narrow sections (or section) 144 connected together. Optionally, tube 126 is fitted with a nozzle 148 to thereby eject flushing water in a jet or fast stream in order to unclog an obstruction.

Optionally or alternatively, in some embodiments of the invention, flushing tubes 126 are flexible, or partially flexible, to ease installation thereof.

In some embodiments of the invention, apparatus 120 comprises a tank 112 which can be used to store chemicals that may be added to flushing water in flushing tube 126 from a tank 112 for example via a pipe 114 and regulated by a valve 116.

Figure 2A:
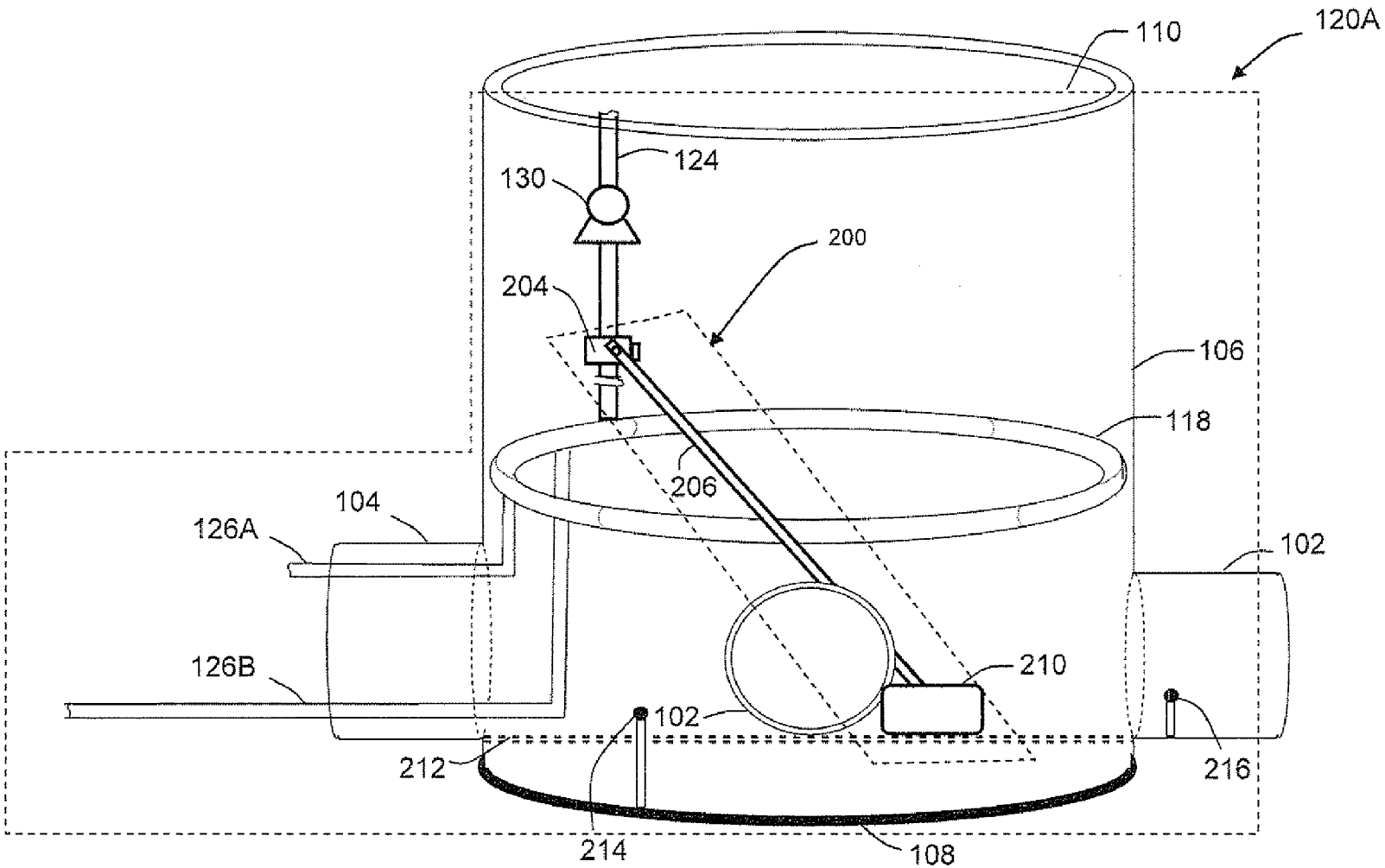
FIG. 2A and FIG. 2B schematically show a further embodiment of the apparatus the present invention adapted for automatic operation, in an inactive and active position, respectively.
Figure 2B:
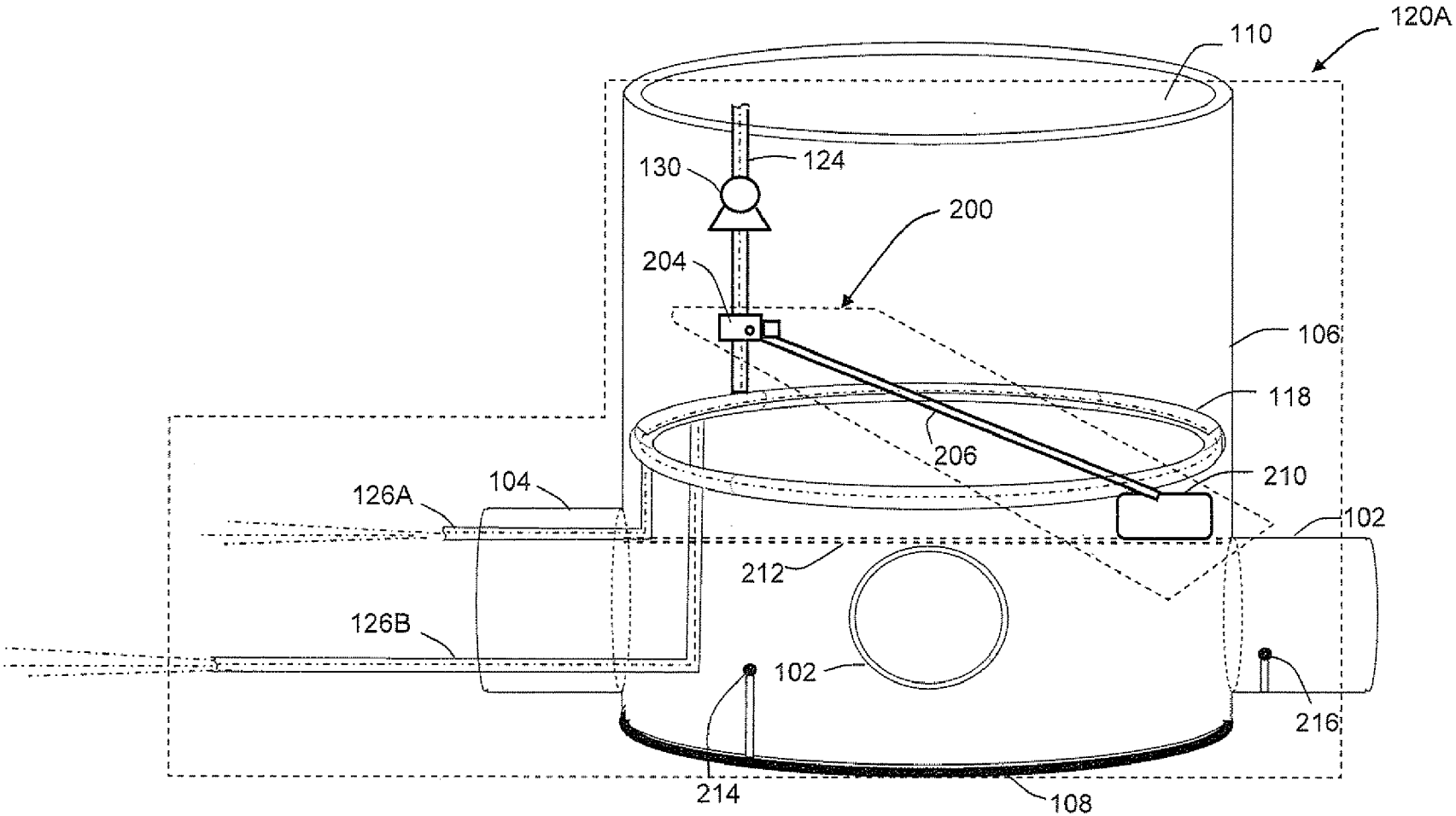

The embodiments shown in FIGS. 2A, 2B and 2C illustrate a manually operated apparatus. According to other embodiments, described herein below, the apparatus is operated automatically. In other words, an obstruction is automatically detected or determined (directly or indirectly) and flushing water is automatically ejected to clear the obstruction.

FIGS. 2A and 2B schematically show an apparatus 120A adapted for automatic operation and unclogging of a drain pipe. In this embodiment, and certain others to be described, the apparatus comprises a mechanism 200 for detecting or determining that a drain pipe is clogged based on the premise that if and/or when the obstruction is disruptive enough, the effluent flow will be hindered and accumulate (back up) in chamber 110 whereby the effluent level will rise in the chamber.

In some embodiments of the invention, mechanism 200 comprises a valve 204 (optionally different and/or a variant of valve 128) and a float 210, both of which are pivotally connected by an arm 206.

Valve 204 is constructed such that it can open or close water supply pipe 124 according to the height of effluent level 212 in chamber 110, and consequently, the level of float 210, as described below.

When effluent level 212 in chamber 110 is low (FIG. 2A), that is, closer to a lower part of outlet pipe 104 than to an upper part of outlet pipe 104, indicating that effluent flow is not significantly hindered, then float 210 positions arm 206 such that valve 204 is closed and flushing water is not supplied to flushing tubes 126.

When effluent level 212 in chamber 110 is high (FIG. 2B), that is, closer to an upper part of outlet pipe 104 than to a lower part of outlet pipe 104, indicating that a drain pipe is clogged, at least partially, then float 210 floats on accumulated effluent and positions arm 206 such that valve 204 is open and water is supplied to flushing tubes 126 for unclogging.

In some embodiments of the invention, the water supply from source pipe 124 is regulated according to the effluent level 212 and, accordingly, according to the flow (or clogging) of an outlet pipe 104. Optionally, the rate of flow or pressure in flushing tubes 126 is regulated according to the level of float 210 (i.e. effluent level 212) by opening or closing valve 204 responsive to the level of the float 210. Optionally, the opening or closing valve 204 is not linear with float 210 level and, for example, a relatively small or partial rise of float 210 affects an essentially complete opening of valve 204 in order to flush tubes 126. In this manner, even a relatively minor obstruction can be removed before it becomes a more significant obstruction.

In some embodiments, the operation of float 210, arm 206 and valve 204 (mechanism 200) is similar to the operation of a toilet flushing mechanism (though in an opposite manner, such that when float 210 is high valve 204 is opened). The embodiment shown in FIGS. 2A and 2B is provided as a non-limiting example, and other mechanisms may be used for controlling and/or regulating valve 204, and accordingly, of water flow in flushing tubes 126. For example, electrically operated valve controlled by a water (or other fluid) sensor 214 located in chamber 110 on base 108 or other locations in chamber 110, or a sensor for the flow rate or velocity of effluent flow in chamber 110 or in outlet stub 104 or inlet stub 102.

It can be recognized that the operation responsive to the level of float 210 may be practical for an obstruction in the effluent flow of outlet pipe 104A. However, by placing a water (or other fluid) sensor or detector 212 in inlet pipe 102A, a clog in inlet pipe 102A may also be determined. For example, a low effluent level in inlet stub 102, e.g. below the level of a sensor 216, can indicate that an obstruction is present upstream of the sensor. Sensor 212 is operably connected to valve 204, whereby a reduced flow, detected by the sensor, opens valve 204. Optionally, a plurality of sensors 212 may be disposed at several levels in inlet stub 102 or inlet pipe 102A, and valve 204 will open (or close) responsive to the lowest (or highest) level of a sensor 212. Optionally, the rate of flushing in flushing tubes 126 is determined is response to the effluent level detected by sensor 214 and/or 216.

The water sensor(s) 214 and/or 216 may comprise, for example, two electric electrodes with different electric potentials, such that when covered with water/effluent (or other conductive medium) electric current flows under the potential difference, which effects (e.g. by using an amplifier) the opening or closing of valve 204.

In some embodiments of the invention, sensor(s) 214 and/or 216 comprise a flow rate meter and/or flow velocity meter disposed in inlet stub 102 or outlet stub 104, so that valve 204 is opened or closed according to the flow in inlet stub 102 or outlet stub 104. For example, when the effluent flow rate is lower than typically expected, valve 204 is opened to flush tubes 126 in inlet pipe 102A or outlet pipe 104A.

In some embodiments, the water sensor or flow meter 212 is disposed in chamber 110, and functions as described above. When the drain is not conductive, other sensors sensitive to the effluent composition may be used.

In some embodiments, valve 204 and/or the sensors described above are used to regulate the pressure of the flushing water. For example, by regulating pump 130 or by other methods such as regulating the water supply pressure by an auxiliary valve.

In some embodiments of the invention, apparatus 120 is installed on an ad-hoc basis. For example, when a clog is identified or suspected, junction 100 is accessed (e.g., by opening a cover of manhole in which the junction is placed) and apparatus 120 is installed to provide water from supply pipe 124 to tubes 126. Optionally or alternatively, apparatus 120 is left installed for future use, optionally with valve 208 closed to save water and it may be assembled with mechanism 200 and/or tank 112. In some embodiments of the invention, apparatus 120 or 120A is installed as a preventive measure, that is, to be ready in case of a clogging and, particularly for apparatus 120A, to operate automatically when clogging is determined or identified.

In some embodiments of the invention, junction 100 is manufactured and/or supplied with apparatus 120 and/or 120A, at least partially. In some embodiments of the invention, junction 100 comprises a section of supply pipe 124 and/or manifold 118 and/or sections of tubes 126 in inlet and/or outlet stubs 102 and 104, and/or optionally valve 128 or 204. Optionally, the chemicals are supplied as part of junction 100, optionally in a bag or container such as tank 112.

Figure 3:
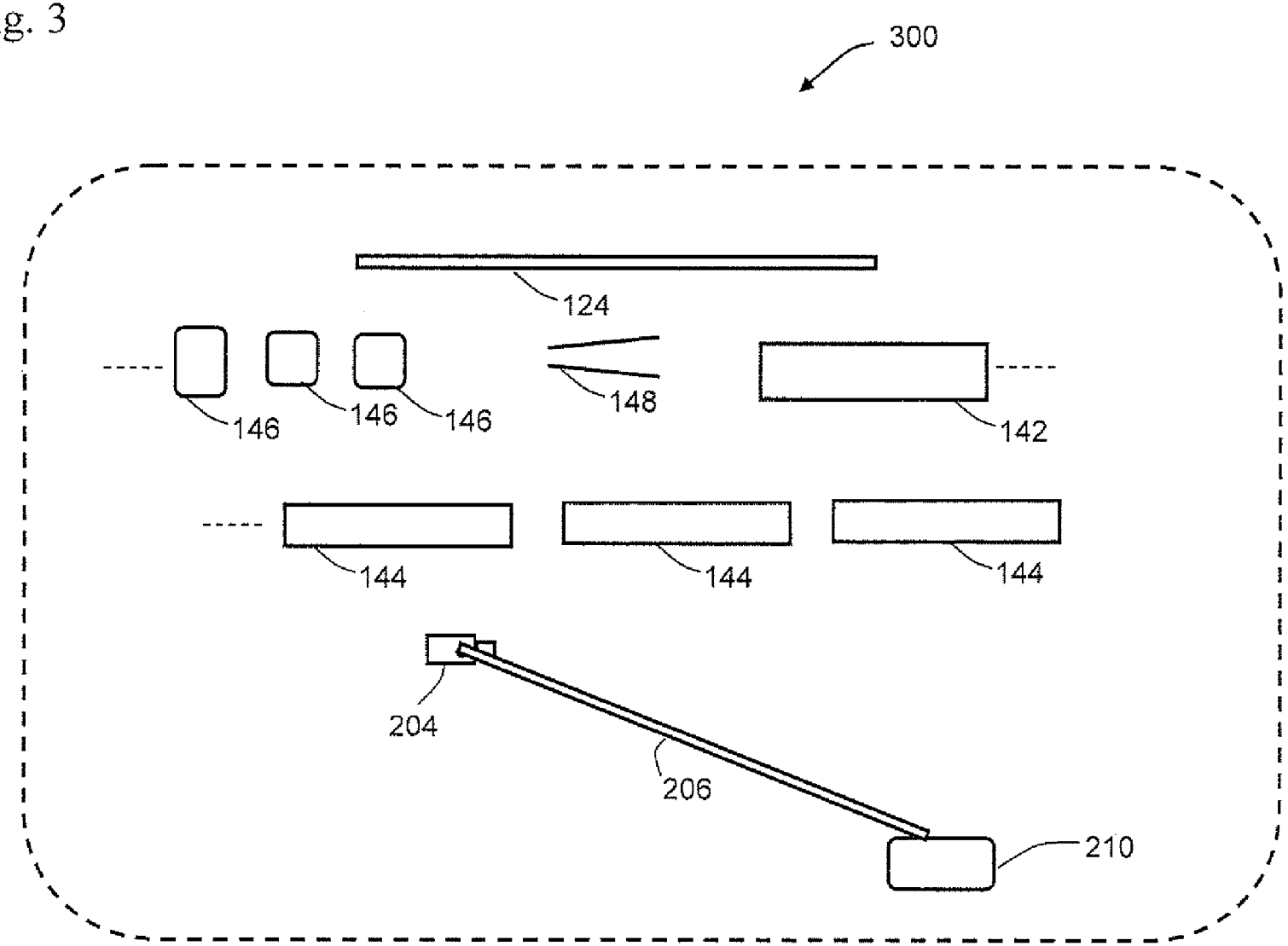
FIG. 3 schematically shows an exemplary kit for flushing an obstruction according to an embodiment of the invention.

In some embodiments of the invention, apparatus 120 and/or 120A, at least partially, are provided as a kit. For example, maintenance personnel may acquire the kit and install it in a drain pipe or junction such as junction 100 or other such plumbing system. Optionally, additional pipes or pipe (or tube) sections may be acquired in order to extend pipes 126, as well as chemicals and pumps. FIG. 3 schematically shows an exemplary kit 300 for flushing an obstruction in a drain pipe, comprising supply pipe 124, valve 204, arm 206 and float 210, as well as tube 126 sections 142, 144, connection sections 146 and ejection nozzle 148. Optionally, the kit comprises at least one chemical for aiding in unclogging an obstruction. Optionally, the kit comprises a tank, for example, such as tank 112 for holding flushing fluid.

Figure 4:
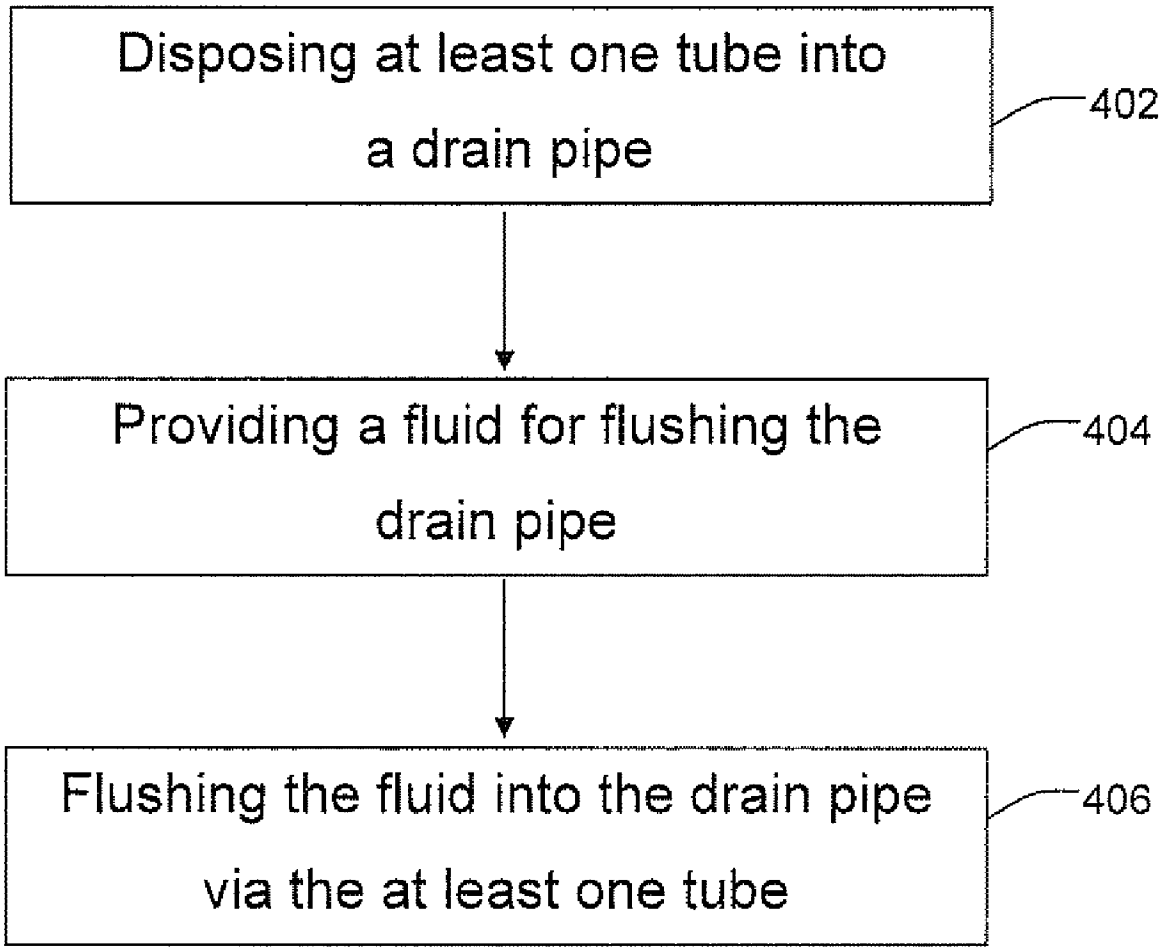
FIG. 4 shows a flowchart of an exemplary method of the invention for unclogging an obstruction in a drain pipe.

FIG. 4 shows a flowchart of an embodiment of a method for unclogging an obstruction in a drain pipe, comprising: disposing at least one tube into a drain pipe (402), providing water for flushing the drain pipe (404), and flushing the water into the drain pipe via the at least one tube (406).

The terms 'vertical', 'perpendicular', 'parallel', 'opposite', 'straight', 'planar', 'rectangular', 'square', 'circular', 'round', 'elliptical', 'oval', 'cylindrical', 'sphere' and other angular and geometrical shapes and relationships and inflections thereof imply also imprecise yet functional and/or practical respective relationships.

The terms 'about', 'approximate', 'substantial', 'significant' and inflections thereof denote, unless otherwise specified or implied in the context, a sufficiently close functional and/or practical respective relation or measure or amount or quantity or degree according to the context in which the terms or their inflections appear.

The terms "comprises", "comprising", "includes", "including", "having" and their inflections and conjugates denote "including but not limited to".

The present invention has been described using descriptions of embodiments thereof that are provided by way of example and are not intended to limit the scope of the invention. The described embodiments comprise various features, not all of which are necessarily required in all embodiments of the invention. Some embodiments of the invention utilize only some of the features or possible combinations of the features. Alternatively and additionally, portions of the invention described/depicted as a single unit may reside in two or more separate physical entities which act in concert to perform the described/depicted function. Alternatively and additionally, portions of the invention described/depicted as two or more separate physical entities may be integrated into a single physical entity to perform the described/depicted function. Variations of embodiments of the present invention that are described and embodiments of the present invention comprising different combinations of features noted in the described embodiments can be combined in all possible combinations including, but not limited to use of features described in the context of one embodiment in the context of any other embodiment.

In the specifications and claims, unless otherwise specified, when a range of values is recited, it is merely for convenience or brevity and includes all the possible sub-ranges as well as individual numerical values within that range. Any numeric value, unless otherwise specified, includes also practical close values enabling an embodiment or a method, and integral values do not exclude fractional values. A sub-range values and practical close values should be considered as specifically disclosed valued.

The invention claimed is:

1. An apparatus for unclogging an obstruction in a drain pipe, comprising:

(a) at least one tube disposed within the drain pipe;

(b) a fluid supply pipe for providing fluid from a fluid source, the supply pipe connected to the at least one tube that delivers the fluid to unclog the obstruction; and (c) an automatic fluid delivery mechanism for regulating fluid delivery in accordance to an effluent flow rate in the drain pipe.

2. An apparatus according to claim 1, configured to flush the fluid from the at least one tube into the drain pipe.

3. An apparatus according to claim 1, wherein the mechanism regulates the pressure of the fluid.

4. An apparatus according to claim 1, wherein the mechanism comprises a valve.

5. An apparatus according to claim 1, further comprising a pump for pressurizing the fluid.

6. An apparatus according to claim 1, further comprising a tank connected to the supply pipe for providing supplementary ingredients to the fluid.

7. An apparatus according to claim 1, wherein the fluid is water.

8. An apparatus according to claim 1, wherein the supply pipe connects to a water source.

9. A method for unclogging an obstruction in a drain pipe, comprising:

(a) disposing at least one tube within the drain pipe;

(b) providing a fluid to the at least one tube; and (c) automatically delivering and regulating flushing fluid into the drain pipe for at least partially unclogging the obstruction, in accordance with an effluent level or flow rate in the drain pipe.

10. A method according to claim 9, wherein the fluid is water.

11. A method according to claim 9, further comprising supplementing the fluid with ingredients for assisting in unclogging the obstruction.

12. A method according to claim 9, further comprising pressurizing the fluid to a pressure above the pressure in the drain pipe.

13. A method according to claim 12, wherein pressurizing comprises obtaining pressure from a regional water supply.

* * * * *